US008713734B2

(12) United States Patent
Davis

(10) Patent No.: US 8,713,734 B2
(45) Date of Patent: May 6, 2014

(54) AERATED BUMPER AND LINER SYSTEM FOR A BABY CRIB

(76) Inventor: Leonard A. Davis, Palmdale, CA (US)

( * ) Notice: Subject to any disclaimer, the term of this patent is extended or adjusted under 35 U.S.C. 154(b) by 115 days.

(21) Appl. No.: 13/464,112

(22) Filed: May 4, 2012

(65) Prior Publication Data

US 2012/0284919 A1 Nov. 15, 2012

Related U.S. Application Data

(60) Provisional application No. 61/485,023, filed on May 11, 2011.

(51) Int. Cl.
*A47D 15/00* (2006.01)

(52) U.S. Cl.
USPC ..... 5/663; 5/424; 5/93.1; 5/946

(58) Field of Classification Search
USPC ..... 5/93.1, 98.1, 424, 425, 427, 663, 946
See application file for complete search history.

(56) References Cited

U.S. PATENT DOCUMENTS

| | | | | |
|---|---|---|---|---|
| 5,410,765 | A * | 5/1995 | Youngblood | 5/93.1 |
| 6,170,101 | B1 * | 1/2001 | McCloud | 5/424 |
| 6,178,573 | B1 * | 1/2001 | Wagner et al. | 5/424 |
| 6,957,464 | B1 * | 10/2005 | Coauette | 5/663 |
| 7,055,192 | B2 * | 6/2006 | Waters et al. | 5/424 |
| 8,539,626 | B2 * | 9/2013 | Dunne et al. | 5/663 |

* cited by examiner

*Primary Examiner* — Michael Trettel
(74) *Attorney, Agent, or Firm* — Kelly & Kelley, LLP

(57) ABSTRACT

An aerated bumper and liner system for a baby crib provides increased airflow into and out of the baby crib while creating a soft pad to guard the baby against injury. The bumper and liner system includes pads with apertures that allow for added air circulation. Each pad may further include ties for attaching the pad to the bars of the crib. Support stays are included in the liner pads to help ensure that the liner pad do not sag once put in place in the crib.

8 Claims, 4 Drawing Sheets

AERATED BUMPER AND LINER SYSTEM FOR A BABY CRIB

BACKGROUND OF THE INVENTION

A baby typically sleeps in a crib for the first 18 to 36 months of his life. Standard cribs include an elevated mattress surrounded by vertical bars that are joined by a balustrade at the top. The vertical bars are evenly spaced at an interval that is narrow enough that the baby's head and body cannot fit through but wide enough that sufficient air circulation is allowed across the mattress of the crib. Adequate circulation is extremely important for babies as their developing bodies are particularly susceptible to the damaging effects of carbon dioxide and other breathable chemicals.

It is common for babies to shift and move while they are in their cribs. As such, a baby may wedge himself into a corner of the crib or against the bars. In an effort to prevent the baby from injuring himself against the bars of the crib, parents often line the crib with a padded bumper or with a liner. Such bumpers and liners are usually six to twelve inches tall and attach to the bars of the crib. The bumper or liner attaches to the inside of the crib and encompasses the perimeter of the mattress so that the baby is protected on all sides from injuring himself against the crib bars.

A problem arises in that as a baby shifts toward the edge of the crib mattress, there is a risk that his face might become wedged against the bumper or liner, thereby smothering him. Also, the bumper or liner decreases the amount of air that circulates across the mattress of the crib. This means that less oxygen moves into the crib, while carbon dioxide pools around the baby lying in the crib. The reduced air flow across the mattress may contribute to Sudden Infant Death Syndrome (SIDS), a major concern for very young children.

Thus, there is a need for a baby crib bumper or liner that allows for increased air flow across the mattress while still providing a soft barrier around the interior of the crib such that the baby does not injury himself on the bars of the crib.

SUMMARY OF THE INVENTION

The present invention is directed to an aerated bumper and liner system for use in a baby crib. The system includes a series of pads created by attaching two pieces of fabric or other material together. Each pad features a plurality of apertures cut through both sides of the pad. Each pad also features a series of ties along the top and bottom of the pad, and spaced so that the placement of each tie corresponds with the position of a bar of the crib. This ensures that each pad can be securely fastened to the crib so that it will not fall over or shift sideways. The pad can either include filling, making it a bumper, or it can remain unfilled with support stays, making it a liner.

In the preferred embodiment, the aerated bumper and liner system includes four pads that are sized to conform to the inner perimeter of a baby crib. The pads are positioned adjacent to the baby crib mattress against the bars of the crib. In this position, the bumper or liner pads create a barrier that guards the baby from injuring himself against the bars of the crib.

When support stays are positioned in between the first and second pieces of fabric, the aerated pad is a liner. The support stays are horizontally spaced such that each pad resists sagging when tied to the baby crib. When the aerated pad includes a soft filling instead of support stays, it is a bumper and resists sagging because the soft filling provides the pad with enough structure to stay up-right. Each pad, whether a liner or a bumper, also includes a series of ties positioned along the top and bottom of the pad. These ties are preferably made of fabric and are long enough to be tied around the bars of the baby crib. The ties ensure that each pad is securely fastened to the bars of the crib such that there is no danger that the pad will fall over and smother the baby in the crib. The ties also ensure proper placement of the pad.

The apertures of the present invention provide for increased airflow into the baby crib. The apertures in the preferred embodiment of the present invention are bordered by a stitched border. This stitched border ensures that the apertures cut through both sides of the pad remain correctly aligned. The stitched border also ensures that any filling in between the sides of the bumper stays in place without falling through the apertures and out of the pad. The stitched border of each aperture also creates a divot such that the surface of each pad is dimpled. These divots help reduce the danger that a baby might wedge his face against the pad and suffocate. The apertures are preferably grouped such that at least three apertures remain unblocked at all times in between each pair of bars surrounding the crib mattress.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
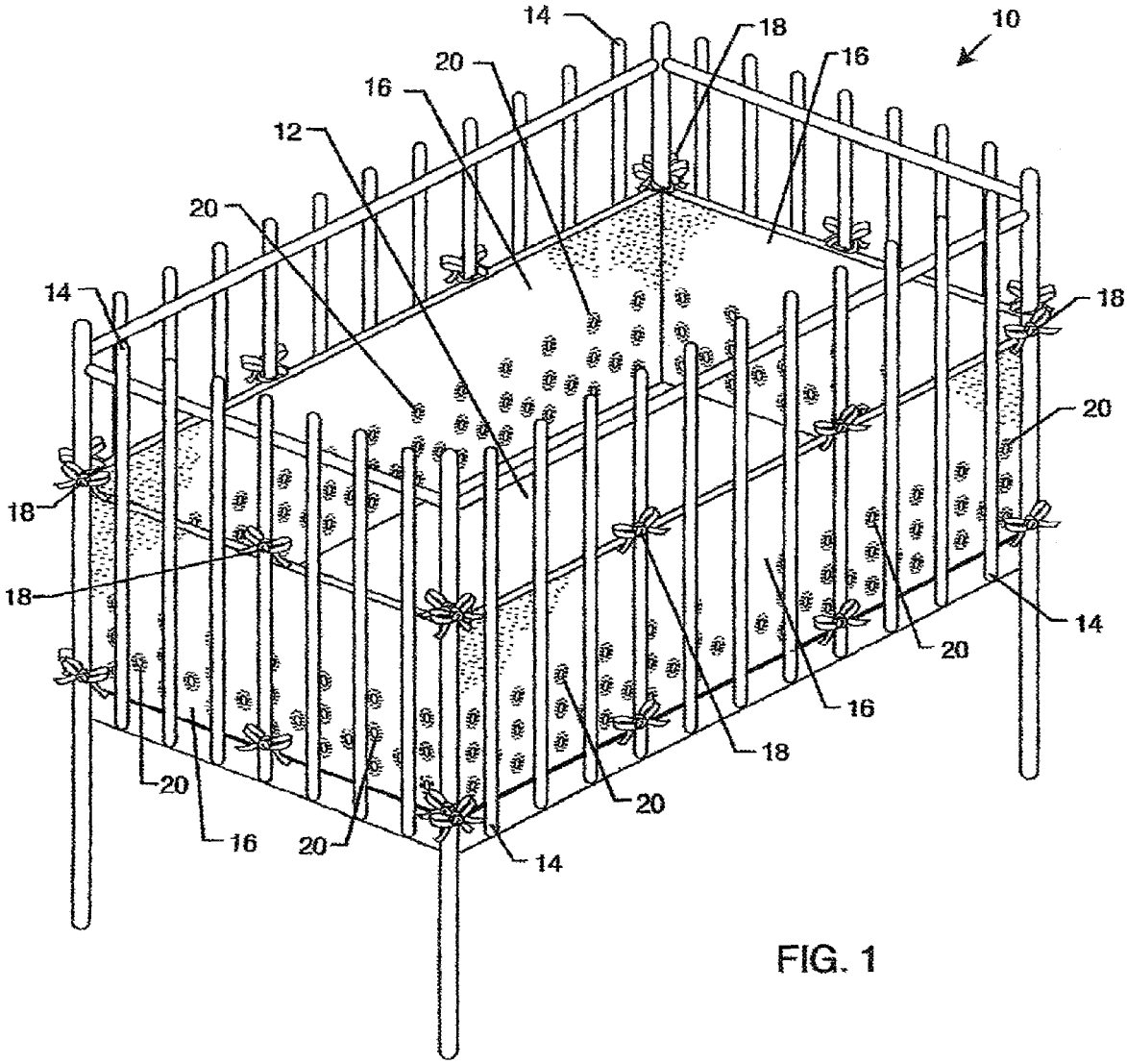
FIG. 1 is an environmental view of the present invention in use in a baby crib.

The present invention is an aerated bumper and liner system for a baby crib. In FIG. 1, the baby crib 10 is shown with the pads 16 in place. The baby crib 10 includes an elevated mattress 12 surrounded by a plurality of vertical bars 14. The bars 14 are spaced far enough apart to allow adequate airflow through the crib, but not so far apart that a baby's arms, legs, head, or torso could fit through and be injured. In the preferred embodiment, the pads 16 are tall enough to cover more than half the height of the bars 16 surrounding the crib 10. This height ensures that if a baby moves to the side of the crib while left unattended, the baby will not injure himself against the bars. Other embodiments may include pads 16 that are even taller so as to cover all of the bars 14 of the crib 10.

FIG. 1 also illustrates the placement of the ties 18 and the apertures 20 of the present invention. The ties 18 are placed along the top and bottom of the pads 16 and are spaced so as to correspond with the placement of the bars 14 of the baby crib 10. When each pad 16 is put in place along the inside perimeter of the bars 14, each tie 18 lines up with a bar 14. The ties 14 can then be tied to the bars 14 along the top and bottom of the pad 16. The ties 14 ensure that the pads 16 stay in place without falling over or shifting sideways. More or less ties 14 can be included in different arrangements according the manufacturer's needs.

Figure 2:
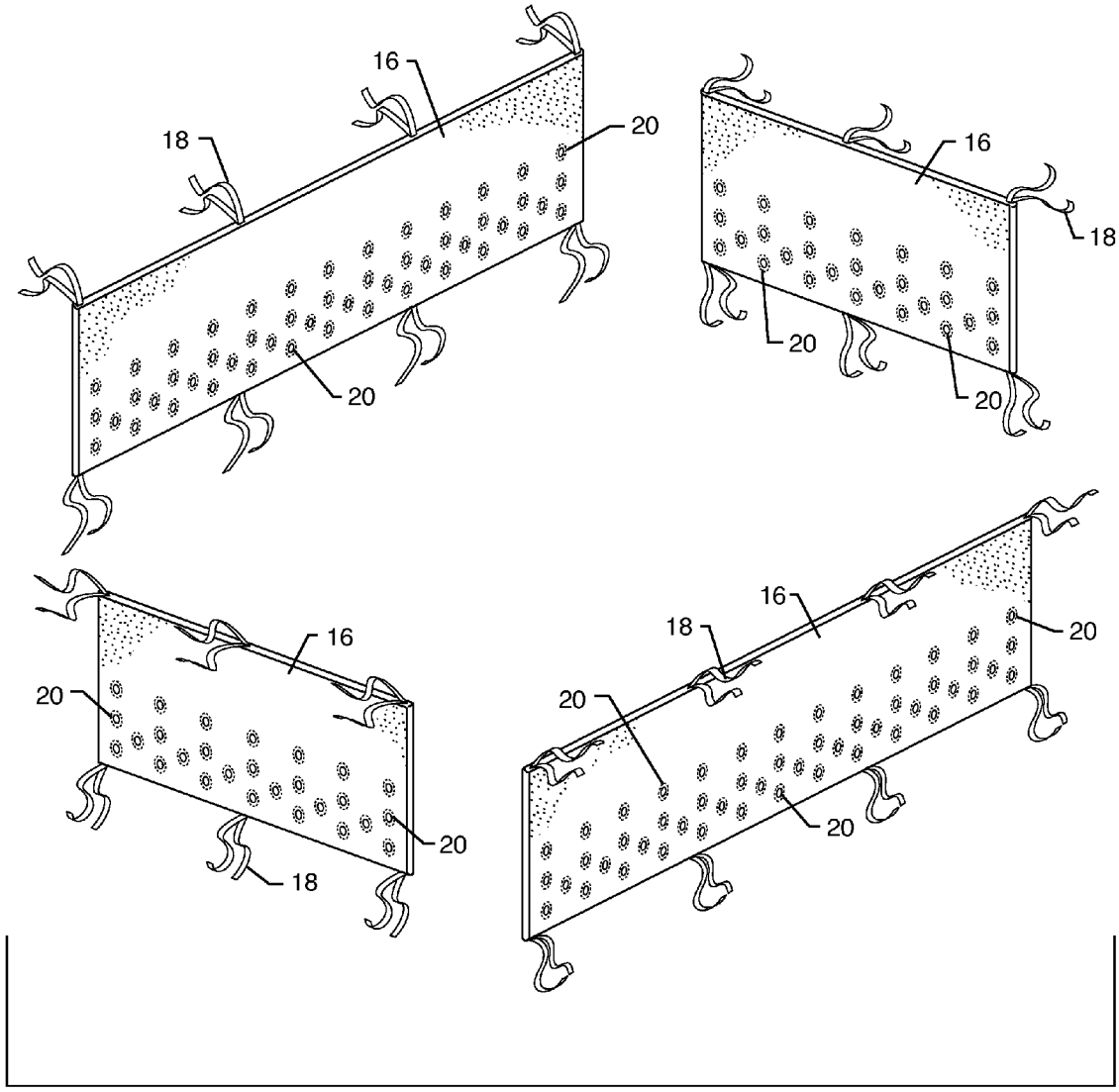
FIG. 2 is a perspective view of the present invention.

FIG. 2 shows the present invention as it is when not attached to a baby crib. The present invention includes a series of pads 16. In the preferred embodiment, the pads 16 come in two sizes so as to fit the inside of a rectangular baby crib. In other embodiments, the pads 16 can be formed into any shape necessary to substantially conform to the inside perimeter of a given baby crib. Each of the pads 16 features ties 18, placed in pairs along the top and the bottom of the pad 16. Each of the pads 16 also includes multiple apertures 20 cut through the pad 16. This allows for airflow to come through the pad 16 at any angle.

Figure 3:
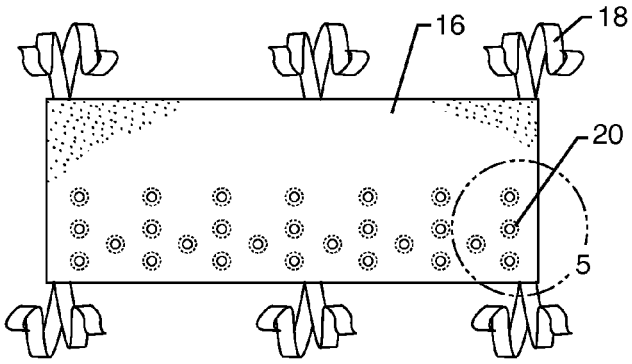
FIG. 3 is a side view of one pad from the present invention illustrating the placement of the apertures and ties.
Figure 4:
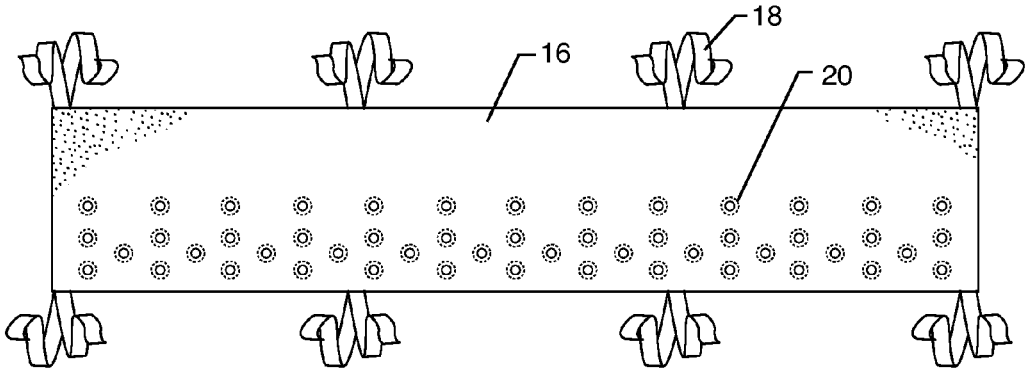
FIG. 4 is a side view of one pad of the present invention illustrating the different pad sizing.

The placement of the apertures 20 is best seen in FIGS. 3 and 4. The apertures 20 are stacked and spaced to allow a maximum amount of air to flow into and out of the crib while still providing a soft pad to protect the baby from injuring himself against the crib bars. The placement of the apertures 20 is designed so that at least three apertures remain unblocked between each pair of crib bars 14.

Figure 5:
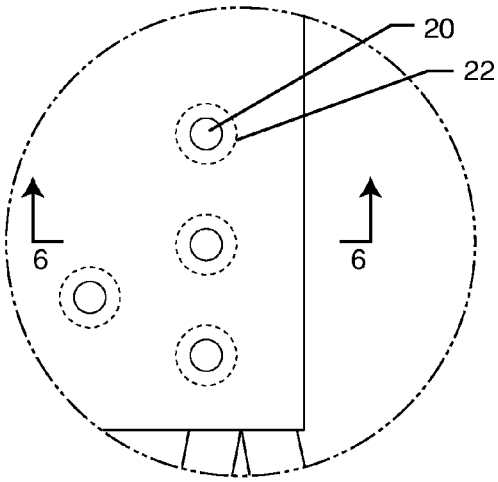
FIG. 5 is a magnified view of the placement of the apertures illustrating the placement of the apertures for maximum airflow.

A close-up view of the apertures 20 is shown in FIG. 5. Here, the apertures 20 are shown in their preferred grouping. This figure shows the stitched border 22 that surrounds each aperture 20 in the preferred embodiment. In other embodiments, the apertures can be defined by a soft grommet, fusible web, or glue. In any embodiment, it is important that the apertures 20 be defined by a material that is soft and has no sharp edges. This is so the pad 16 will not create a danger for a baby inside the crib.

Figure 6:
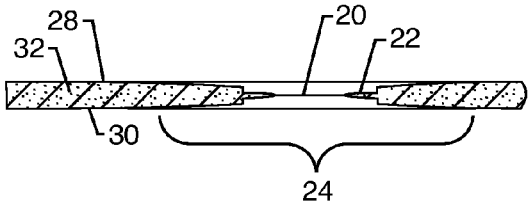
FIG. 6 is a top-down view of the present invention illustrating the divot created by the stitched border around each aperture in the filled bumper.

FIG. 6 also shows the stitched border 22. Here, it is shown how the stitched border 22 helps hold the first side 28 and the second side 30 of each pad together. Each pad is constructed with a first side 28 and a second side 30 preferably made of fabric. In the preferred embodiment, the fabric is breathable and machine washable. In other embodiments, the first side 28 and the second side 30 may be made of other materials that are suitable for use in a baby crib.

The first side 28 and the second side 30 of each pad is held together by seams along the edges of each pad (not shown), but without extra stitching, the first side 28 may sag away from the second side 30 along the central portion of the pad. The stitched borders 22 of the apertures 20 provide for this extra support. FIG. 6 also shows the filling 32 disposed in between the first side 28 and the second side 30 in the preferred embodiment of the present invention, creating a bumper. In the preferred embodiment, a soft filling 32 is included between the first side 28 and the second side 30 of the bumper pad 16 so as to provide even more cushioning against the bars 14 of the crib 10. The stitched border 22 provides enough structure that the filling 32 stays in place and the apertures 20 remain un-obstructed.

When the aperture 20 is stitched into place in a filled or unfilled pad 16, the stitched border creates a divot 24. The divot 24 is instrumental in ensuring that the surface of the pad 16 is not completely flat. If a baby were to wedge his head against a completely flat pad, there is a danger that his face would press up against the flat surface and his airway would become blocked. A dimpled surface created by multiple divots 24, as in the present invention, ensures that there is no flat surface for a baby to press his face against.

Figure 7:
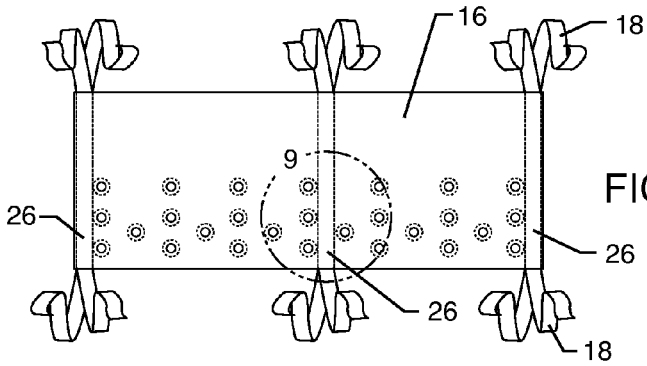
FIG. 7 is a side view of the present invention illustrating the placement of the support stays in the liner as well as the placement of the apertures around the support stays.
Figure 8:
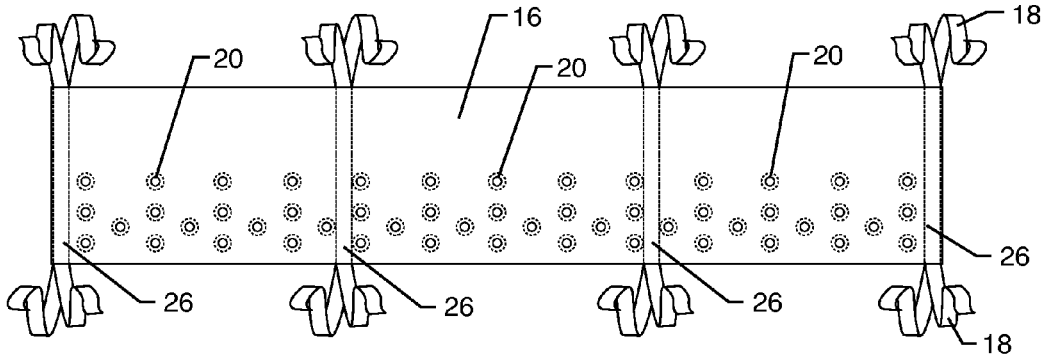
FIG. 8 is a side view of the present invention illustrating the placement of the support stays in the liner as well as the placement of the apertures around the support stays.
Figure 9:
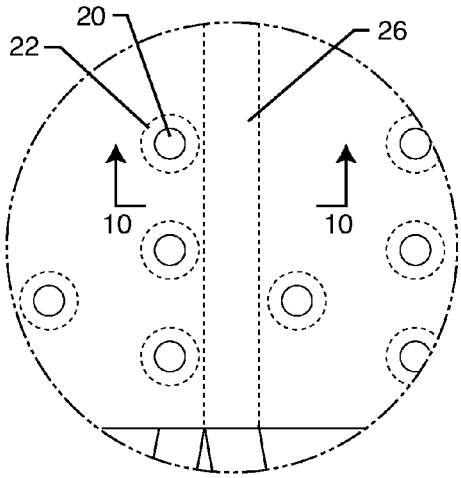
FIG. 9 is a magnified view of the placement of the apertures and the support stay.
Figure 10:
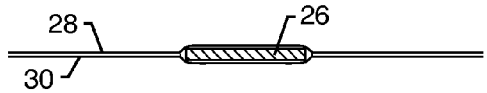
FIG. 10 is a top-down view of the support stay illustrating its placement in-between the layers of the liner of the present invention.

FIGS. 7 and 8 show the support stays 26 of the present invention. The support stays 26 are included to add extra support to unfilled pads 16, creating liners. The support stays are provided to prevent the liner pads 16 from sagging. The support stays 26 are vertically placed in the liner pads 16 and are positioned to correspond with the placement of the pairs of ties 18 along the top and bottom of each of the liner pads 16. FIG. 9 shows that the support stay 26 is positioned in the liner pad 16 such that it does not interfere with the apertures 20. The support stays 26 can be made of any material that is more rigid than the first side 28 and the second side 30 of the liner pad 16, but not so rigid that it creates a hazard if a baby presses up against it. Such materials can include cardboard, fabric, plastic, and other similar materials. The placement of the support stay 26 is shown in the top-down view of FIG. 10 where the support stay 26 is disposed in between the first side 28 and the second side 30 of the pad 16.

Although several embodiments have been described in some detail for purposes of illustration, various modifications may be made without departing from the scope and spirit of the invention. Accordingly, the invention is not to be limited, except by the appended claims.

What is claimed is:

1. An aerated system for a baby crib comprising:

a plurality of pads wherein each pad comprises a first elongated strip of fabric and a second elongated strip of fabric joined together along their edges;

a plurality of apertures cut through the first and second elongated strips of fabric in each pad;

a plurality of ties attached at the edges of the first and second elongated strips of fabric of each pad; and a plurality of support stays positioned in between the first and second elongated strips of fabric of each pad, wherein each of the plurality of support stays is horizontally spaced such that each pad resists sagging when tied to the baby crib, and wherein each of the support stays are disposed proximate to each of the plurality of ties.

2. The aerated system of claim 1, wherein the plurality of pads consists of four rectangular pads, wherein the four rectangular pads are substantially co-extensive with the crib mattress and the bars of the baby crib.

3. The aerated system of claim 1, wherein the plurality of pads comprise a soft filling between the first and second elongated strips of fabric and contained therein by the joined edges of the first and second elongated strips of fabric.

4. The aerated system of claim 1, wherein the apertures are bordered by a stitched border.

5. The aerated system of claim 4, wherein the stitched border of each aperture creates a divot such that the surface of each pad is dimpled.

6. The aerated system of claim 1, wherein the ties are positioned in corresponding pairs along the top and bottom of each pad.

7. The aerated system of claim 1, wherein the ties are made of fabric and are configured to be tied around bars of the baby crib.

8. An aerated system for a baby crib comprising:

four rectangular pads substantially co-extensive with the crib mattress and the bars of the crib, wherein each pad comprises a first elongated strip of fabric and a second elongated strip of fabric joined together along their edges;

a plurality of apertures cut through the first and second elongated strips of fabric in each pad, wherein the apertures are bordered by a stitched border creating a divot such that the surface of each pad is dimpled and the apertures are evenly disposed along one-half of each pad;

a plurality of support stays positioned in between the first and second elongated strips of fabric of each pad, wherein each of the plurality of support stays is horizontally spaced such that each pad resists sagging when tied to the baby crib; and a plurality of fabric ties attached at the edges of the first and second elongated strips of fabric of each pad, wherein the plurality of ties are made of fabric and are positioned in corresponding pairs along the top and bottom of each pad proximate to each of the plurality of support stays.

* * * * *